United States Patent [19]

Leshner et al.

[11] 4,015,569

[45] Apr. 5, 1977

[54] FUEL METERING AND VAPORIZING SYSTEM FOR INTERNAL COMBUSTION ENGINES

[75] Inventors: Ervin Leshner; Michael D. Leshner, both of Cherry Hill, N.J.

[73] Assignee: Fuel Injection Development Corporation, Bellmawr, N.J.

[22] Filed: Jan. 7, 1976

[21] Appl. No.: 647,120

[52] U.S. Cl. ..... 123/133; 123/32 ST; 123/119 R; 123/122 E; 123/39 BG; 261/50 A

[51] Int. Cl.[2] ..... F02M 7/18; F02M 31/02

[58] Field of Search ... 123/119 R, 139 AW, 140 MC, 123/32 ST, 32 SP, 191 S, 32 SJ, 133, 122 E, 139 BG, 32 EA, 32 ED, 119 EC; 261/50 A

[56] References Cited

UNITED STATES PATENTS

| | | | |
|---|---|---|---|
| 1,245,519 | 11/1917 | Smith | 123/122 X |
| 2,175,126 | 10/1939 | McCormick | 123/133 |
| 2,315,881 | 4/1943 | Thomas | 123/133 X |
| 2,330,650 | 9/1943 | Weiche | 261/50 |
| 2,481,130 | 7/1958 | Reggio | 123/119 |
| 2,615,437 | 10/1952 | Broderson | 123/32 A |
| 2,710,605 | 6/1955 | McDonnell | 123/133 |
| 2,813,522 | 11/1957 | White et al. | 123/119 R |
| 3,142,967 | 8/1964 | Schweitzer | 60/105 |
| 3,470,858 | 10/1969 | Mycroft | 123/139 |
| 3,502,055 | 3/1970 | Beesch | 123/32 SJ |
| 3,596,643 | 8/1971 | Schweitzer | 123/117 A |
| 3,696,798 | 10/1972 | Bishop et al. | 123/32 ST |
| 3,713,630 | 1/1973 | Laprade et al. | 123/119 R X |
| 3,771,504 | 11/1973 | Woods | 123/140 MC X |
| 3,789,816 | 2/1974 | Taplin et al. | 123/119 R |
| 3,906,909 | 9/1975 | Garcea | 123/97 B |
| 3,949,714 | 4/1976 | Mitchell | 123/140 MC X |

*Primary Examiner*—C. J. Husar
*Assistant Examiner*—Tony M. Argenbright
*Attorney, Agent, or Firm*—Woodcock Washburn Kurtz & Mackiewicz

[57] ABSTRACT

A charge forming system for metering vaporized liquid fuel to an internal combustion engine. Liquid fuel is metered to a vaporizing chamber which is heated by the exhaust gases of the engine. Within the chamber the liquid vaporizes and expands rapidly, whereupon it is delivered to the intake ports of the engine to be mixed with air in the manifold or cylinders. The amount of fuel and air admitted to the engine is varied as function of both foot pedal position and developed engine power. The fuel-to-air ratio of the mixture provided to the cylinders is decreased as developed engine power increases. In a preferred embodiment additional fuel vapor is supplied to each combustion chamber by means of fuel vapor injectors, the net mixture supplied to the cylinders being leaner than the stoichiometric ratio. A feedback system monitoring selected engine parameters serves to vary the rate at which air is admitted to the engine, and an adjustable mechanism is provided to further adjust the proportions of the fuel-to-air ratio.

28 Claims, 3 Drawing Figures

FUEL METERING AND VAPORIZING SYSTEM FOR INTERNAL COMBUSTION ENGINES

BACKGROUND OF THE INVENTION

The present invention relates to charge forming systems for internal combustion engines and more particularly to an improved system for metering and vaporizing liquid fuel, and delivering it to an engine in optimum quantities.

Since the inception of the internal combustion engine, continuting efforts have been made to improve the charge forming system to achieve both the efficient and economical delivery and combustion of fuel. Of the vast sums of capital and human energy which have been expended to improve and refine the internal combustion engine, it is fair to say that the aspect of engine system which has received the most concerted attention is the charge forming system. Many types of carburetion and fuel injection systems have been devised, the vast majority of them having been abandoned as inadequate, impractical or uneconomical. Among these approaches have been numerous attempts to vaporize liquid fuel before its induction into an engine. As used herein, the term "vaporize" will be used in its true sense, in contradistinction to "atomization" as is accomplished by conventional carburetion and fuel injection systems. In this context, "atomization" denotes the dividing of a liquid into a multiplicity of small droplets, while "vaporization" will refer to the actual dissociation of the liquid molecules as, for instance, in the conversion of water to steam.

The search for improved charge forming systems has received added impetus in recent years due to the progressive constraints being placed upon vehicle emissions. In order to reduce the various pollutants normally emitted by conventional internal combustion engines, renewed efforts have been made to devise charge forming systems which burn "cleanly" as compared to previous systems. Unhappily, the systems implemented to date achieve reduced emissions at the price of decreased engine power and economy. In order to reduce emissions automotive engineers have found it necessary to retain the basic elements of the conventional charge forming system, turning to highly modified carburetors along with added accouterments such as conduits for recycling exhaust gas and means for selectively retarding ignition timing, along with thermally compensated systems for providing as lean a mixture as possible over the anticipated range of operation.

Newer, more sophisticated approaches continue to rely upon conventional carburetion or fuel injection systems which have been "programmed" to respond to various anticipated conditions in a predetermined manner. With the advent of microelectronics, it has become possible to construct an electronic system for controlling the operation of carburetors or fuel injectors by synthesizing signals representing the desired system operation, in response to sensed stimuli. However, all of the foregoing systems continue to be constructed about a basically conventional charge forming means. Due to the superimposing of control stages, sensors, and pre-programmed electronic controllers the systems have become increasingly complex and expensive. Moreover, as the number of components of the system increases, the inherent reliability of the system necessarily decreases.

Still another feature which has been attempted to be implemented into charge forming systems for spark ignited internal combustion engines is the capability of adapting to various diverse sorts of liquid fuels. Since for each fuel a particular fuel/air ratio must be maintained by the charge forming system over the entire range of engine operation, it has been found difficult to adapt prior art systems to receive various, diverse sorts of liquid fuels.

Accordingly, it will be understood from the foregoing that there is a continuing need for a charge forming system for an internal combustion engine which is readily adaptable for use with various sorts of liquid fuels, and for a system which provides optimal engine efficiency and performance over an intended operating range, while minimizing the emission of pollutants from the engine.

It is therefore an object of the present invention to provide an improved charge forming system for an internal combustion engine with superior fuel distribution characteristics.

It is another object of the present invention to provide an improved charge forming system for metering and vaporizing a liquid fuel.

Another object of the invention is to provide an improved fuel metering system which is readily adaptable for use with diverse liquid fuels.

Still another object of the present invention is to provide a system for implementing the formation of stratified charges in an internal combustion engine wherein a leaner-than-stoichiometric strata of the charge is derived from vaporized liquid fuel.

Yet another object of the invention is to provide means for automatically maintaining optimal proportions of vaporized fuel and air in an internal combustion engine.

Another object is to provide a charge forming system which achieves a significant diminution in pollutant output.

SUMMARY OF THE INVENTION

Briefly stated, in accordance with one aspect of the invention the foregoing objects are achieved by providing means for varying the rate of flow of fuel and air as a function of both a manually-controlled operator signal, and a manifestation of developed engine power. The liquid fuel is delivered to a vaporizing chamber which is advantageously heated by the exhaust gases flowing from the engine. Within the chamber the fuel vaporizes and subsequently passes through distribution ducts to be ingested through intake ports of the engine. The incremental rates of change of fuel and air flow differ for a given change in engine power such that as developed engine power increases the fuel-air mixture becomes leaner.

In a preferred embodiment liquid fuel is delivered to engine fuel injectors which vaporize small amounts of fuel and ignite them to develop an igniting flame within each combustion chamber. The main charge of vaporized fuel is metered to the cylinders through conventional valving in such amounts as to support a charge having a less-than-stoichiometric fuel-air ratio. A feedback system may be used to extend the range of the system and/or to vary the fuel-air ratio which the system is constrained to maintain so that diverse fuels may be utilized.

DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

The present invention is related to, and in some aspects comprises an improvement of the invention set forth in co-pending application Ser. No. 647,326 filed Jan. 7, 1976 by the inventors of the present system.

Figure 1:
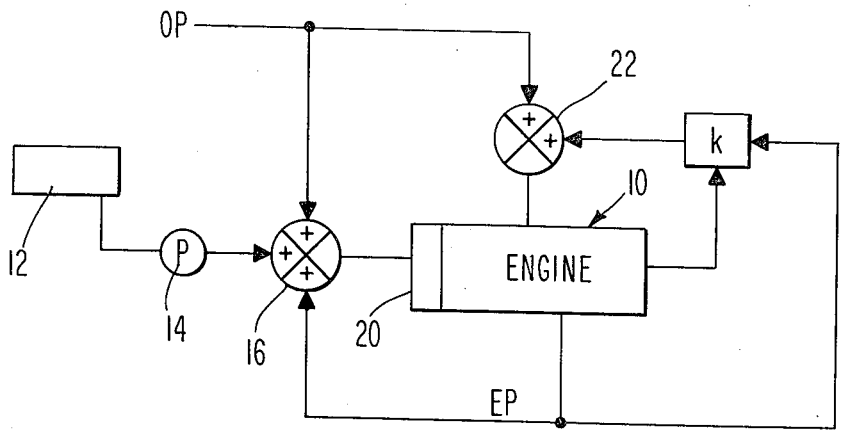
FIG. 1 is a simplified schematic diagram illustrating one embodiment of the present invention.

Referring now to FIG. 1, a charge forming system is shown in idealized form, and coupled to an internal combustion engine 10. In the illustrated system, a reservoir of liquid fuel is maintained in tank 12, and urged therefrom under pressure by means of a pump 14 to a fuel flow regulator 16. The regulator 16 operates in response to a first signal OP input which may represent the position of a manually displaceable element, and a second signal EP, representative of developed engine power.

The fuel outputted by regulator 16 is passed to a vaporizer 20, which utilizes heat from engine 10 to convert the liquid fuel into a vapor state from whence it is distributed to the cylinders of the engine.

Air flow to engine 10 is controlled by means of a throttle mechanism 22. In the disclosed embodiment the throttle mechanism responds to the position of a manually displaceable element whose position is manifested by signal OP. The throttle mechanism is also responsive to a signal EP which comprises a manifestation of developed engine power.

The operation of the system disclosed in FIG. 1 will now be explained, making particular reference to the elements enumerated in the Figure. In order to start engine 10, pump 14 is operated to supply fuel under pressure to regulator 16. A low-level signal OP, produced for instance by a slight depression of a foot pedal, allows raw fuel to be supplied to presently-inoperative vaporizer 20. The raw fuel traverses the vaporizer and is drawn into the intake manifold of engine 10.

It has been found that most fuel maintained under atmospheric pressure contains approximately 20% dissolved air. Accordingly, as the unvaporized fuel enters the manifold the relatively low pressure in the manifold, produced by the cranking of the engine with a substantially closed throttle, causes a portion of the raw fuel to vaporize. The thus-vaporized fuel is sufficient to cause engine 10 to start, whereupon the heat from the exhaust gases rapidly raises the temperature of vaporizer stage 20 for vaporizing the liquid fuel therein. For starting under very cold conditions a manual or automatic valve may be provided to supply small quantities of raw fuel to the intake manifold. The throttle mechanism 22 opens sufficiently to supply the amount of air necessary to obtain the desired fuel-air ratio. Engine signal EP, which comprises a manifestation of developed engine power, is fed back and combined with operator signal OP to decrease the fuel-to-air of the mixture being ingested by the cylinders. As engine power increases the mixture is "leaned out" further until power stops increasing. In this manner the leanest mixture possible for a given power output is established. This is defined herein as the optimum condition of engine operation.

As the temperature of vaporizer 20 rises sufficiently so that all of the fuel metered thereto is vaporized before entry into engine 10, the normal mode of operation is attained. As the signal OP is increased to increase the power outputted by engine 10, additional fuel is vaporized and made available to the engine. Throttle mechanism 22 is opened to an appropriate degree so as to provide the proper amount of air to engine 10 for maintaining optimum engine operation. In a preferred embodiment, a slight time lag exists in the response of fuel regulator 16 to changes in the power outputted by the engine. This time lag is adequate to allow for the transit time of the fuel from the regulator through vaporizer 20 and into the intake manifold of engine 10. Accordingly, as the flow of fuel and air to the engine is increased by virtue of an increased signal OP the power developed by the engine increases. A consequent increase in the manifestation of developed power EP then occurs. Signal EP is fed back to the fuel and air metering apparatus to effect a relative increase in air flow with respect to fuel flow. The fuel-to-air ratio decreases until engine power stops increasing, at which time the optimum (leanest possible) condition obtains.

When it is desired to decrease the speed of, or diminish the power demanded from, engine 10 the signal OP is reduced. This may be accomplished by, for example, retracting a foot pedal under an operator's control. The signal EP derived from engine 10 then decreases, allowing the desired optimum condition to be established at a lower power level.

Under constant power conditions, which for instance may occur when a motor vehicle is cruising at constant speed, the feedback system serves to maintain the fuel-to-air ratio at its optimum. Small, constant fluctuations in speed and/or load are automatically compenstated for by the system whereby decreases in engine power effect a richer mixture and conversely engine power increases cause the mixture to become leaner.

Figure 2:
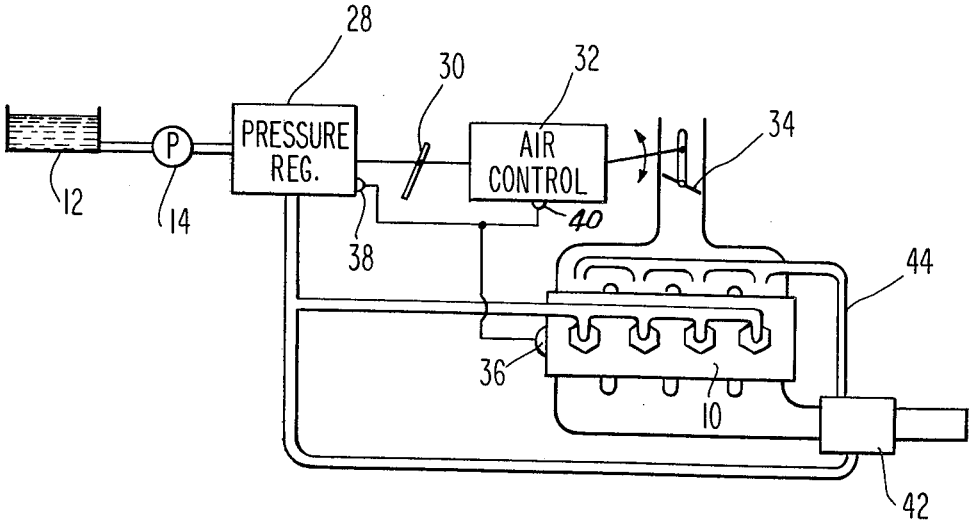
FIG. 2 is an illustration of one presently preferred embodiment of the invention.

FIG. 2 shows in greater detail a charge forming system as schematically illustrated in FIG. 1. Those elements corresponding to the elements enumerated in FIG. 1 are designated by corresponding numerals. As was set forth with respect tO preceding FIG. 1, fuel from tank 12 is supplied by pump 14 to subsequent apparatus for regulating the pressure and accordingly the rate of flow of the fuel. In one preferred embodiment, a pressure regulator generally shown at 28 is provided, and coupled to a foot pedal 30 by means of appropriate linkage.

Pedal 30 is also coupled to air regulation mechanism 32 which serves to operate a throttle 34 for varying the flow of air to engine 10. In addition to the control exercised over pressure regulator 28 and air control 32 by means of pedal 30 an additional, engine-related signal is also provided for varying the fuel-to-air ratio of the mixture ultimately ingested by the cylinders of the engine. To this end an output signal EP is derived, for instance by an appropriate output transducer 36, and applied to the charge forming system. In the illustrated embodiment the signal from transducer 36 is applied to pressure regulator 28 by means of an output transducer means 38. Further, the signal is advantageously applied to air control 32 by means of a second output transducer means 40.

It should here be noted that by "transducer" is meant any appropriate mechanism for deriving a disired manifestation and/or communicating or applying said manifestation to control apparatus for providing a desired result. Accordingly, it will be understood that transducers 36, 38 and 40 may be electrical, mechanical, hydraulic or pneumatic. In the present invention the transducers are used to provide a manifestation of power actually developed by engine 10. While the actual method selected to this end is not a necessary part of the present invention, in a successfully-tested embodiment exhaust back pressure was utilized. It will be recognized, however, that various other parameters may be selected. For instance, a combination of torque and RPM signals can be used to produce an indication of engine power. Alternatively peak or average combustion chamber pressure may be used, for instance by coupling one or more combustion chambers through a conduit to a liquid-filled expansible enclosure which in turn motivates an appropriate linkage. It may alternatively be advantageous to use the mass rate of air flow into the engine, or exhaust gas temperature, as indications of developed power. In the case where exhaust gas temperature is selected as a parameter for use with the illustrated system, it may be desirable to utilize apparatus such as that discloses and claimed in co-pending application Ser. No. 591,608 filed June 30, 1975 by Ervin Leshner entitled "Mounting Thermocouples in Internal Combustion Engines" and relating to means for deriving the exhaust gas temperature of an internal combustion engine.

While transducers 38, 40 are shown for operating upon pressure regulator 28 and/or air control 32 in accordance with manifested engine power, it will be appreciated that the schematically-shown transducers may actually consist in the internal construction of the air-fuel control apparatus, whereby a variation in flow is effected in response to some change in manifested engine power. Further, while in the preferred embodiment a manifestation of engine power is applied to both fuel and air flow control apparatus, it will be understood that for a given application it may be feasible to dispense with one or the other transducer such that only fuel flow, or only air flow, is varied in response to changes in developed engine power. As will be developed hereinafter, a principal feature of the operation of the illustrated system is that it serves to diminish the fuel-to-air ratio with incremental increases in engin power. This end may be attained by diminishing fuel flow, increasing air flow, or varying both fuel and air flow disproportionately such that a "leaner" mixture is ingested by cylinders of engine 10.

In the embodiment illustrated in FIG. 2 a signal manifesting developed engine power is applied to both the fuel pressure regulator 18 and the air control 32, and serves to vary fuel and air flow in a predetermined manner. In the presently preferred embodiment the inventors have found it advantageous to cause both fuel and air flow to be increased with an increase in engine power, the percentage increase in air flow which is effected by an engine power feedback signal being larger than the percentage increase in fuel flow such that an increasingly leaner charge is provided to the engine. This system assures that maximum fuel flow cannot be delivered to engine 10 merely by depressing pedal 30 but must occur under full load conditions, when the fuel supplied can be totally consumed. This avoids the possibility of flooding engine 10 by fully depressing the foot pedal 30 when the engine is operating at low speeds or at low power. It is contemplated that in some applications, however, it may be appropriate to achieve a leaning-out of the fuel-air mixture by diminishing the rate of fuel flow, by increasing the rate of air flow, or both.

The foregoing apparatus corresponds closely to that described and claimed in co-pending U.S. patent application Ser. No. 647,326 filed Jan. 7, 1976, and entitled "Improved Fuel Delivery System for Internal Combustion Engines". The system presently disclosed and illustrated in the various Figures comprises an improvement over the system in the latter co-pending patent application however, in that it provides a more readily-ignitable mixture to engine 10 and facilitates a substantial diminution in the pollutants outputted by the engine.

Liquid fuel outputted by pressure regulator 28 is directed through an appropriate conduit to a vaporizing chamber generally shown at 42. The vaporizing chamber is mounted in heat transfer communication with the exhaust system of engine 10 so that the waste heat outputted by the engine is used to vaporize the incoming, liquid fuel. As the fuel vaporizes, it expands rapidly and flows through a distribution conduit 44 into the intake manifold of the engine. Of course, it is also possible to direct the vaporized fuel directly to the cylinders of the engine; however, it is believed that with the most practical adaptation of presently-produced engines the vapor is directed into an existing manifold system. The vapor, which consists almost entirely of dissociated fuel molecules, is then ingested into the engine and burned in generally the same manner as vaporized liquid fuel.

In a preferred embodiment the liquid fuel is directed to fuel vapor injectors 46. Although it is possible to adapt various types of fuel injection mechanisms for use with the invention, in a successfully tested embodiment the fuel vapor injectors 46 comprised mechanisms such as those described and claimed in U.S. Pat. No. 3,926,169 issued Dec. 16, 1975 to Ervin and Michael Leshner. The injectors may advantageously be mounted to an engine in place of conventional spark plugs, and serve to introduce a jet of vaporized fuel into the combustion chamber of the engine. The apparatus also serves to ignite the jet of vaporized fuel to provide a torch-like igniting flame of substantially greater surface area than conventional igniting means, such as electric sparks. The highly-enriched mixture from the injectors is easily ignitable, and serves to readily ignite leaner-than-stoichiometric mixtures in the combustion chamber. This ignition principle is basically similar to that upon which engines of the stratified charge variety operate. However, unlike stratified charge engines the present system achieves the ignition of a vaporized, leaner-than-stoichiometric mixture by a small, enriched flame without requiring any physical modifications to conventional, spark-ignited engines.

The system illustrated and described above has numerous advantages over conventional charge forming systems as heretofore known, not the least of which are improved economy of operation and substantially diminished pollution levels. Although the mechanisms by which these highly desirable goals are reached are as yet imperfectly known, the following explanation is believed to be substantially correct.

In conventional charge forming systems liquid fuel is atomized into a multiplicity of fine droplets, which are then introduced into an engine cylinder and ignited. Since liquids cannot burn, and must first dissociate into free molecules, in order for the contents of each liquid droplet to ignite the surface thereof must first evaporate into the surrounding oxygen (air). Accordingly, each droplet as it burns is surrounded by a flame front into which diffused vaporizing liquid.

As is well known vaporization requires the addition of substantial heat, i.e. the heat of vaporization, for a given substance. Accordingly, a significant portion of the heat energy produced in the combustion process is absorbed in vaporizing the atomized fuel droplets. Further, the foregoing process is relatively slow, requiring adequate time for the various droplets to be fully vaporized and diffused into the combustion flame.

With the inroduction of already-vaporized fuel into a cylinder, however, combustion can take place almost immediately. Since discrete droplets are not present, no heat energy is absorbed by evaporation; further, a flame front can propagate through the vaporized medium more rapidly than through a volume filled with discrete droplets. Accordingly the combustion process proceeds much more quickly, and develops greater power than in conventional combustion processes and the tendency of a lean mixture flame to quench is diminished.

The results of the foregoing combustion procedure, when properly implemented, provide a striking improvement in engine operation. First, as the vapor is more homogeneous and more easily transported to remote points within an engine a more uniform fuel mixture is provided to the cylinders. Secondly, since heat energy is not absorbed from the combustion process to vaporize the fuel, additional heat energy is present in each engine cylinder to provide more pressure upon each piston and, accordingly, more useful output power. Finally the more rapid combustion process affords less time for the production of oxides of nitrogen, which comprise a substantial source of pollution. The production of oxides of nitrogen depends principally upon temperature, availability of oxygen, and available time for the pertinent chemical reactions to proceed. By speeding up the combustion process the time available for the formation of oxides of nitrogen is substantially reduced, and accordingly the pollution produced by the engine is substantially diminished.

Figure 3:
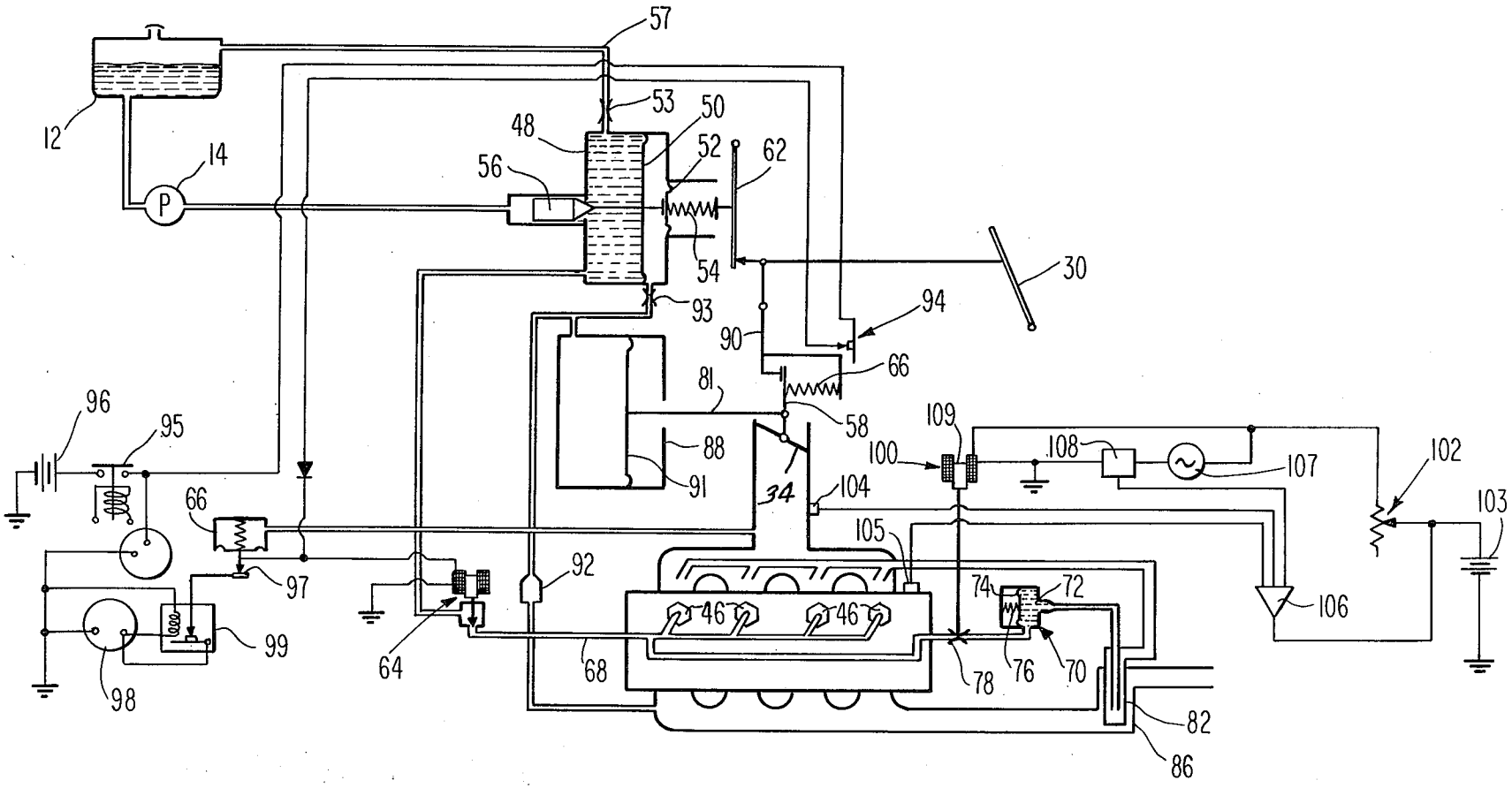
FIG. 3 is a detailed schematic drawing of an implementation of a preferred embodiment of the invention.

Turning now to FIG. 3, there is shown in detail a presently preferred implementation of the preferred embodiment of FIG. 2. As before, liquid fuel stored in tank 12 is supplied to a pressure regulator 28 by means of an appropriate pump 14. The pressure regulator is coupled to a foot pedal 30 by way of an appropriate linkage. Within the body 48 of the fuel pressure regulator diaphragm 50 divides the major part of the regulatOr into two sections, a leftward section for receiving liquid fuel and a rightward section which receives a manifestation of developed engine power, as will be discussed hereinafter. A second diaphragm 52 serves to isolate the rightward chamber from atmospheric pressure, and provides a bearing surface for a spring 54 against which pedal 30 bears by way of lever 62.

A vent 51 having a restriction 53 therein may be provided the regulator for bleeding off vapor bubbles which may accumulate in the regulator. A metering valve 56 is coupled to the diaphragms by appropriate means, and is adapted to seat in an orifice which provides communication between fuel pump 14 and the fuel-receiving chamber within the regulator. The liquid fuel flowing from regulator 28 is supplied to a shutoff valve 64. As can be seen from the Figure, shutoff valve 64 may comprise a solenoid-operated valve mechanism. Coupled in circuit with solenoid valve 64 is a vacuum switch 66 which is operative to disable valve 64 in the presence of a high manifold vacuum. The valve size, spring rate and diaphragm are of switch 66 are selected so that valve 64 will pass fuel in the presence of idling engine vacuum, and will shut off fuel flow when engine vacuum increases due to closed throttle deceleration.

In a preferred embodiment, the fuel outputted by cutoff valve 64 next passes through a manifold 68 which is coupled to a plurality of fuel injectors 46. While injectors 46 are not necessarily intended to designate any particular type of injection apparatus, it has been found that the instant system operates extremely well in conjunction with the fuel injector-igniter devices disclosed and claimed in applicants' U.S. Pat. No. 3,926,169. It is anticipated that the amount of fuel flowing to injectors 46 will be relatively small, and not substantially diminishing the pressure of the liquid fuel. The liquid fuel, after passing through manifold 68 flows through a buffer valve 70, and thence to vaporizer stage 20.

The inventors have found that in order to produce the desired results from the vapor-supplying portion of the charge forming system it is necessary to somehow dissociate the effects of engine manifold vacuum from the fuel pressure regulation mechanism. Accordingly buffering valve 72 is provided in the line. Valve 72 is advantageously placed as close to vaporizer 20 as possible, so as to minimize the amount of fuel between the valve and the intake manifold of engine 10. If necessary, small orifices may be located at appropriate points in the liquid fuel distribution circuit to vent vapors that may form in the flowing fuel.

Referring now to buffer valve 70, it will be seen that the valve comprises a metering needle 72 coupled to a diaphragm 74 which is biased by spring 76 in the manner of a pressure regulator. The buffer valve serves to maintain a substantially constant pressure at the inlet thereof so that the outlet passage of fuel pressure regulator 28 will encounter a constant pressure. This provides a predictable flow for any given position of the metering needle of the pressure regulator. In particular, it will be seen that the liquified fuel flowing from buffer valve 70 into vaporizer 20 undergoes rapid expansion as it vaporizes due to the heat within the vaporizer, supplied by the exhaust stream of engine 10. The expanding vapor is drawn into the intake manifold of the engine, and serves to provide a mixture upon which the engine may operate. Despite the rapid and dramatic expansion of the vaporizing fuel, the manifold vacuum within the intake manifold of engine 10 is communicated back through the fuel system and in the absence of buffer valve 70 would cause erratic performance by the preceding regulator stage. Therefore, the present inventors have provided buffer valve 70 to decouple the effect of the engine manifold vacuum from the fuel pressure regulation stages.

In order to adapt a common fuel delivery system for use with engines of various displacements and accordIngly varying fuel requirements, a variable restriction 78 is advantageously disposed between regulator 28 and vaporizer 20. The restriction may comprise a replaceable apertured element, and can be disposed at any convenient location such as the inlet fitting of buffer 70.

Turning now to vaporizer 20, this apparatus may conveniently be formed of a pair of concentric, corrosion-resistant tubes made from a material such as stainless steel. Liquid fuel enters through an inner tube 80, absorbing heat energy as it approaches the bottom end of the tube. As the fuel impinges upon the outer tube 82, it is rapidly vaporized and rises through the outer tube, ultimately being distributed to the engine by distribution duct 84. The outer casing 86 of the vaporizer may be formed of cast iron or other appropriate material, such as is commonly used for exhaust manifolds. In one successfully tested embodiment, casing 86 comprises the initial length of headpipe connected to a cast iron exhaust manifold, with tubing 80, 82 extending therewithin.

In order to easily distribute the vapor from vaporizing stage 20 it may be desirable to introduce the vapor into passages formed in the intake manifolds of present-day engines for the purpose of recirculating exhaust gases in the engine. Varied other approaches may be selected, however, it being understood that the specific means utilized to introduce the vaporized fuel to engine 10 does not form a critical part of the present invention.

In the preferred embodiment depicted in FIG. 3 an electrically operated arrangement is provided for cutting off fuel flow to the vaporizer under certain conditions. A pair of parallel circuits are provided for delivering current to solenoid valve 64, the first of which extends through throttle switch 94 and starter switch 95 to a source of emf such as battery 96. The other circuit is constituted by a pair of contacts 97 which are operated by vacuum switch 66, and an engine-speed related source of potential such as a generator 98 and associated regulator 99.

With the foregoing circuitry fuel flow is cut off when pedal 30 is fully depressed while the engine is being cranked. Under starting conditions no substantial emf is produced by generator 80 but current may flow through switches 94, 95 to energize the solenoid 64. When pedal 30 is fully depressed switch 94 is opened and valve 64 closes, as is to be desired when it is wished to clear a flooded engine. After the engine starts valve 64 is energized, despite the opening of switch 95, by generator 98.

In the present embodiment the air flow through engine 10 is constrained to be a function of both the position of pedal 30 and the power being delivered by the engine. An air servo 88 is mechanically coupled by means of a link 81 to throttle 34. The attitude of the throttle is nominally controlled by a bellcrank 90 which is coupled to one side of the arm 58 of the throttle through a biasing spring 66. The servo comprises a pneumatic cylinder having a flexible diaphragm 91 therein whose position, along with that of pedal 30, determines the attitude of throttle 34. Exhaust back pressure, which is preferred embodiment constitutes signal EP, is supplied to the air servo through an appropriate conduit including vapor trap 92. The conduit is also connected to the area between diaphragms 50 and 52 of pressure regulator 28. A restriction 93 is provided so that a lag in operation is experienced between incremental change in the position of pedal 30, and a corresponding increase in fuel flow due to signal EP. This lag in operation serves to compensate for a similar lag in the fuel delivery system, due in part to the vaporization stage disposed between the fuel metering stages and the engine. As pressure upon pedal 30 is increased the pressure of the fuel supply to servo 22 increases correspondingly. Throttle 34 is simultaneously openened to maintain an approximately constant fuel-air ratio within engine 10.

With the increase in fuel and available air to engine 10 the speed and/or power of the engine increases. An increase in engine power effects a commensurate change in the manifestation of developed power EP which in turn further increases both fuel flow and air flow. As set forth above, air flow increases more rapidly than fuel flow to "lean out" the mixture supplied to the cylinders. This is accomplished by means of servo 88, acting in response to a manifested increase in engine power. As diaphragm 91, and thus link 81, advance throttle 34 is opened against the pressure of spring 66. The degree to which the throttle opens in response to any given amount of exhaust back pressure may be predetermined by the characteristics of servo 88 and spring 66. The system is, however, self-compensating inasmuch as the throttle will continue to be opened until the maximum (leanest) air-fuel ratio is achieved for a given engine power output.

When rapid deceleration is desired pedal 30 is released and the high manifold vacuum which results operates valve 66 and opens switch contacts 97, allowing fuel cutoff valve 64 to close. In this manner no fuel is supplied to the engine unnecessarily. When the engine vacuum drops to its normal operating range valve 64 again opens.

In order to cause throttle 34 to track engine operation with even greater precision, a feedback system may be provided as is shown in the Figure. A solenoid 100 is coupled to variable restriction 78 and is operative to control the effective size of the restriction. As the position of the core 109 of solenoid 100 varies with current flowing therethrough, an adjustment 102 is provided, which may comprise a potemtiometer coupled in circuit with a source of emf 103. Potentiometer 102 thus provides a facile adjustment by which an operator may vary the rate of fuel flow for any given fuel pressure. This response in part determines the air-fuel ratio to be maintained by the system, so that the system may be adapted for use with various different fuels merely by virtue of the simple adjustment of potentiometer 102.

In order to maintain the desired fuel-air ratio over the entire range of engine operation, means are provided for monitoring engine operation parameters which relate to developed engine power. A suitable transducer 104 is coupled to the engine intake manifold to provide a manifestation of manifold pressure. Engine RPM is similarly derived by another transducer 105 and is supplied, along with the manifold pressure signal, to a differential amplifier 106. It should be apparent to those skilled in the art that various other engine parameters could alternatively have been selected. For instance, exhaust back pressure or exhaust gas temperature (EGT) could have been used. EGT may be sampled by one or more thermocouples embedded in an exhaust manifold gasket so as to extend within the stream of flowing gas, as set forth in U.S. Pat. No. 3,968,689, entitled MOUNTING THERMOCOUPLES IN INTERNAL COMBUSION ENGINES, which issued on July 13, 1976.

The output of amplifier 106 is applied to the windings of solenoid 100, so as to immediately correct the position of throttle 34 in the presence of an undue variation in engine operation attributable to a change in air-fuel ratio. In this manner a system is provided for automatically maintaining a predetermined air-fuel ratio, initially selected by the adjustment of potentiometer 102, over a broad range of operating conditions.

As a further refinement of the illustrated feedback control a source of alternating potential 107 is coupled to solenoid 100 in series with an appropriate detector 108. The degree of variation or ripple which is introduced into current flowing through the windings of solenoid 100 by regular perturbations in applied voltage is a function of the inductance of the windings. The actual inductance is in turn a function of the position of core 109 so that by detecting fluctuations in solenoid current the position of core 109 may be inferred. This information is derived by an appropriate detection mechanism and applied to amplifier 106 to maintain core 109 in the position established by the other signals received by the amplifier and representing the appropriate engine parameters.

Operation of the system of FIG. 3 will now be discussed, making reference to the various elements enumerated above. In order to start engine 10, fuel pressure is supplied by means of pump 14 to fuel regulator 28. The liquid fuel traverses valve 64, buffer 70 and vaporizer 20 which, in the present example, is assumed to be inoperative in the absence of heat from engine exhaust gases. Nonetheless, it has been found that the raw, liquid fuel will vaporize as it enters the low-pressure intake manifold of the engine. This effect is attributable to two causes. Firstly, the greatly reduced vapor pressure experienced within the intake manifold while the engine is being turned with throttle 34 closed; and, secondly, the fact that a fuel such as gasoline which has been maintained under atmospheric pressure contains up to 20% air dissolved therein. Under the relatively low pressUre in the intake manifold, the air returns to gaseous form, aiding in the vaporization of the liquid fuel.

Flooded Condition

If for any reason the engine 10 becomes flooded, the operator depresses the foot pedal 30 fully. Switch 94 is then opened and solenoid valve 64 disabled to stop fuel flow. Meanwhile throttle 34 is opened to a considerable extent. Accordingly the engine can continue to be cranked by means of a starter until the excess liquid fuel is exhausted therefrom. Should the engine start during this process, releasing pedal 30 slightly will allow fuel to commence flowing once more. If the engine does not start, pedal 30 may be released and the starting process re-initiated.

Acceleration

When it is decided to accelerate engine 10 or, more precisely, to derive additional power therefrom, pedal 30 is depressed. The increased pressure against second diaphragm 52 forces metering needle 56 leftward, opening the fuel inlet orifice and passing more fuel to the vaporizer. If fuel injectors 46 are present, the additional pressure forces added fuel through the injectors. Whether the injectors are used or not, the additional fuel is forced through restriction 78, buffer 70 and vaporizer 20, from whence it is delivered through distribution conduit 84 into the manifold of engine 10.

The increase in engine power results in an increase in exhaust back pressure and so in the pressure supplied to regulator 28 and air flow control 88. Due to the disparity in the area of diaphragms 50 and 52, the increased pressure will cause metering valve 56 to be further displaced from its seat, allowing more fuel to flow. In addition, the increased pressure acting against diaphragm 91 of air servo 88 will advance link 81 against the pressure of spring 66 to effect an increased opening of throttle 34. The system is calibrated so that the incremental increase in fuel flow is less than the increase in air flow so that the charge ingested by the engine becomes leaner. If the mixture is not at its optimum value the "leaning" which occurs effects an increase in manifested power, which causes the mixture to become still more lean. This activity continues until the leanest possible mixture for a given level of power output is attained.

Engine Deceleration

The deceleration of engine 10 proceeds in a manner substantially the converse of that just described. In particular, as foot pedal 30 is released the fuel flowing from the pressure regulator is diminished. At the same time, throttle 24 is caused to admit less air to the engine, with the result that engine manifold vacuum increases. The lessening of engine power aids in the diminution of fuel and air flow, by tending to close metering needle 56 of the fuel pressure regulator and by causing servo 88 to withdraw link 81, allowing throttle 34 to close slightly. For abrupt deceleration pedal 30 is released completely, whereby valve 66 allows contacts 97 to open, disabling solenoid valve 64 so that fuel flow is substantially or completely stopped.

Cruising

As the engine is operated under substantially constant speed and load conditions, corresponding to cruising operation in a vehicle, slight fluctuations in engine power output and/or fuel-to-air ratio are accommodated by the feedback aspect of the system. In this manner the fuel-to-air ratio is constantly controlled so as to be as low as possible at all times, minimizIng fuel consumption and pollutant emission.

In accordance with the foregoing description, it will now be appreciated that there has been described herein a truly synergistic charge forming system in which the various elements thereof act in concert to provide fuel delivery characteristics which are ideal for internal combustion engines. Still other advantages, however, inhere in the present system, and which are not immediately apparent from a perusal of illustrations of the system. In particular, the present system provides a substantial diminution in polluting emissions. This long-sought desideratum results partially from the superior control of the fuel/air ratio and to the presence of injectors 46; however, it is also attributable to the combination of these characteristics with the delivery of fuel to the cylinders in vaporized, rather than atomized form.

In a preferred embodiment, the amount of vaporized fuel delivered to the engine by way of distribution conduit 84 is such as to comprise a less-than-stoichiometric fuel/air ratio to the engine. By properly regulating the flow of air to the engine in response to the amount of fuel metered to vaporizer 20 an extremely lean fuel/air mixture is provided. However, unlike previous attempts at providing leaner-than-stoichiometric mixtures, the present system assures almost total homogeneity due to the delivery of fuel in vaporized form. The air/fuel vapor mix which is thus provided is ingested into the engine. The turbulence of the incoming air, along with the turbulence encountered within the combustion chambers of the engine, provides sufficient mixing to assure a uniform charge distribution to each cylinder. By utilizing fuel vapor injectors of the type disclosed in U.S. Pat. No. 3,926,169 it has been found possible to ignite such lean mixtures much more easily than with conventional ignition devices. In particular, with the injectors of the aforementioned U.S. patent a stream of ignited fuel vapor is projected into and across each combustion chamber so that the already-ingested, lean fuel-air mixture is penetrated by an elongate igniting flame. The flame thus constituted impinges upon a far greater volume of charge than do prior art igniting devices, and assures total and rapid combustion of even an inordinately lean mixture. Another advantage which obtains with the present system, and which arises due to the synergistic combination of ingested fuel vapor and extended-flame injectors, is the rapidity with which the charge burns within the combustion chamber. In particular, it is believed that with normal charges, fuel remains in droplet form. In order to burn, however, the fuel must first change into actual vapor form. As is well known to those skilled in the art, the actual vaporization of a liquid, even in droplet form, absorbs considerable heat, i.e., the heat of vaporization of the liquid. This vaporizing activity then exerts a quenching effect upon the flame propagating within the combustion chamber, and delays its advance. With the present system, however, since the charge already consists of already-vaporized fuel, further vaporization is unnecessary and the charge burns at a much more rapid rate than with conventionally-carbureted or fuel injected engines. Due to the rapid burning of the charge the chemical constituents, including end products, of combustion are exposed to high temperatures for a considerably lesser time than with prior art systems. Accordingly, certain objectionable emissions such as oxides of nitrogen, do not have sufficient time to form completely and therefore engine emissions are substantially reduced.

As will be evident from the foregoing description, certain aspects of the invention are not limited to the particular details of the examples illustrated, and it is therefore contemplated that other modificatons or applicatons will occur to those skilled in the art. It is accordingly intended that the appended claims shall cover all such modifications and applications as do not depart from the true spirit and scope of the invention.

What is claimed as new and desired to be secured by Letters Patent of the U.S. is:

1. A charge forming system for an internal combustion engine including at least one cylinder and having an inlet manifold including a throttle member, comprising:

manual control means;

transducer means adapted to be coupled to the engine for providing a manifestation of changes in developed engine power;

regulating means for controlling the flow of fuel and air to the engine, said regulating means being coupled to said manual control means and said transducer means and responsive to the latter to progressively change the fuel-to-air ratio of the charge supplied to the engine in a fixed direction as a consequence of a manifested change in developed engine power and continuing the progressive change in fuel-to-air ratio until the manifested change in developed engine power ceases; and vaporizing means coupled to said regulating means and adapted to be coupled in heat transfer relation to the engine for receiving and vaporizing liquid fuel.

2. A charge forming system as defined in claim 1 wherein said vaporizing means comprises an envelope having inlet and oUtlet means, said envelope adapted to be disposed in heat transfer relation to the exhaust stream from the engine.

3. A charge forming system as defined in claim 2 wherein said regulating means comprises a fuel flow regulator coupled to said manual control means.

4. A charge forming system as defined in claim 3 wherein said manual control means comprises a foot pedal.

5. A charge forming system as defined in claim 4 further including a control linkage for being disposed between said foot pedal and the throttle of the engine.

6. A charge forming system as defined in claim 5 further including an air servo coupled to said control linkage and responsive to a manifestation of developed engine power to increase the opening of the throttle in response to a manifested increase in engine power.

7. A charge forming system as defined in claim 6 wherein said regulating means further comprises means responsive to a manifestation of developed engine power for increasing the flow of fuel to the engine in response to a manifested increase in engine power, the percent increase in fuel flow being less than the percent increase in air flow.

8. A charge forming system as defined in claim 7 further including adjustment means for varying the rate of fuel flow produced by a given setting of said fuel flow regulator.

9. A charge forming system as defined in claim 8, further including feedback means for receiving a manifestation of engine operation and controlling the response of the throttle member to said air servo.

10. A charge forming system as defined in claim 9 wherein the engine is of the spark ignited variety, further including fuel vaporizing and igniting means adapted to be associated with each cylinder of the engine and coupled to said fuel flow regulator for receiving liquid fuel and for discharging and igniting a stream of fuel vapor into each cylinder.

11. A charge forming system for automatically providing a charge of the optimum fuel-to-air ratio to an internal combustion engine having intake and exhaust manifolds over a broad range of operation, comprising:

manually displaceable means for affording operator control of engine operation;

air throttle means coupled to said manually displaceable means;

transducer means adapted to be coupled to the engine for providing a manifestation of developed engine power;

air flow control means coupled to said means for providing and to said air throttle means and responsive to said manifestation of developed engine power for progressively increasing the net throttle opening in response to a manifested increase in engine power until the power developed by the engine ceases to increase;

fuel vaporizing means adapted to be disposed in heat transfer relationship to the exhaust manifold of the engine and having an outlet coupled to the intake manifold of the engine; and means for supplying liquid fuel to said fuel vaporizing means.

12. A charge forming system as defined in claim 11, further including a pressure operated buffering means disposed between said fuel vaporizing means and said means for supplying liquid fuel.

13. A charge forming system as defined in claim 12, further including shutoff valve means disposed between said fuel vaporizing means and said means for supplying liquid fuel.

14. A charge forming system as defined in claim 13, further including flow restrictor means disposed between said fuel vaporizing means and said means for supplying liquid fuel.

15. A charge forming system as defined in claim 11, further including fuel injecting means adopted to be operably associated with each combustion zone of the engine for injecting finely-divided liquid fuel directly into the combustion zones of the engine to aid in the ignition of vaporized fuel delivered by said fuel vaporizing means.

16. A charge forming system for continuously and automatically optimizIng the charge supplied to an internal combustion engine, comprising:

means for providing a manifestation of developed engine power;

regulating means for controlling the flow of fuel and air to the engine, said regulating means being coupled to said means for providing to progressively lower the fuel-to-air ratio of the charge ingested by the engine in response to a manifested increase in developed engine power until a cessation of the increase is effected;

vaporizing means coupled to said regulating means and operative to vaporize liquid fuel outputted by said regulating means and to supply the vaporized fuel to the engine; and fuel injector means coupled to said regulating means and operative to supply separate charges of fuel to ones of the cylinders of the engine.

17. A charge forming system as defined in claim 16 further including buffering means coupled between said regulating means and said vaporizing means for preventing variations in inlet manifold vacuum from using undue variations in the flow of fuel from said regulating means.

18. A charge forming system as defined in claim 17 further including a manually positionable element and wherein said regulating means comprises a pressure regulator responsive to movements of said positionable element for varying the amount of liquid fuel outputted by said pressure regulator.

19. A charge forming system as defined in claim 18 further including a cutoff valve disposed between said pressure regulator and said vaporizing means; first means responsive to the operation of an engine cranking means and to the displacement of said manually positionable element to substantially close said cutoff valve under wide throttle, cranking conditions; and second means responsive to high inlet manifold vacuum conditions to substantially close said cutoff valve under high inlet manifold vacuum conditions.

20. A charge forming system for a spark-ignited internal combustion engine having a throttle, comprising:

a manual control linkage adapted to be coupled to a foot pedal;

a liquid fuel flow regulator adapted to be coupled to said manual control linkage;

a throttle linkage for coupling said manual control linkage to the throttle of the engine;

an air servo connected to said throttle linkage for varying the position of the throttle;

means for applying a manifestation of developed engine power to said liquid fuel flow regulator and to said air servo;

said liquid fuel flow regulator and said air servo comprising means responsive to an applied manifestation of an increase in developed engine power for continuously diminishing the fuel-to-air ratio of the charge formed thereby until the manifested, developed engine power ceases to increase;

means for accepting liquid fuel from said liquid fuel flow regulator and transferring heat energy thereto for vaporizing the fuel; and a distribution conduit for transferring vaporized fuel from said last-named means to the engine.

21. A charge forming system as defined in claim 20 wherein said distribution conduit comprises exhaust recirculation passages in the inlet manifold of the engine.

22. A charge forming system as defined in claim 20 further including means for adjustably varying the amount of fuel flow produced by a given setting of said fuel flow regulator.

23. A charge forming system as defined in claim 20 further including fuel vapor injectors adapted to be associated with each cylinder of the engine, said injectors being coupled to said liquid fuel flow regulator and receiving liquid fuel therefrom, said injector being operative to inject a stream of vaporized liquid fuel into each of the cylinders and to ignite the stream.

24. A charge forming system as defined in claim 23 wherein said liquid fuel regulator meters fuel so as to form a leaner-than-stoichiometric charge in each of the cylinders absent the introduction of additional fuel by said fuel vapor injectors.

25. A charge forming system for an internal combustion engine, comprising:

manually displaceable means for affording operator control of engine operation;

means for providing a manifestation of changes in developed engine power;

fuel flow control means coupled to said means for providing and to said manually displaceable means and responsive to a manifested change in developed engine power for progressively changing the fuel-to-air ratio of the charge admitted to the engine until said manifested change in engine power is caused to cease; and fuel vaporizing means adapted to be coupled in heat transfer relation to the engine and in fluid transfer relation to said fuel flow control means for vaporizing liquid fuel.

26. A charge forming system as defined in claim 25 further including buffering means disposed between said fuel vaporizing means and said fuel flow control means for decoupling the latter from effects of engine manifold vacuum.

27. A charge forming system as defined in claim 26 further including flow restrictor means disposed between said vaporizing means and said fuel flow control means.

28. A charge forming system as defined in claim 27 further including fuel injecting means adapted to be operably associated with each combustion zone of the engine for injecting finely-divided liquid fuel directly into the combustion zones of the engine to aid in the ignition of vaporized fuel delivered by said fuel vaporizing means.

* * * * *